United States Patent [19]

Jocham

[11] Patent Number: 4,974,745

[45] Date of Patent: Dec. 4, 1990

[54] PRESSURE COMPENSATING ELEMENT FOR ELECTRICAL DEVICE ENCLOSURE

[75] Inventor: Reinhold Jocham, Mossingen, Fed. Rep. of Germany

[73] Assignee: Robert Bosch GmbH, Stuttgart, Fed. Rep. of Germany

[21] Appl. No.: 348,689

[22] Filed: May 5, 1989

[30] Foreign Application Priority Data

May 7, 1988 [DE] Fed. Rep. of Germany ..... 3815642

[51] Int. Cl.[5] ..... B65D 51/16

[52] U.S. Cl. ..... 220/371; 220/202

[58] Field of Search ..... 220/200, 202, 367, 371, 220/372, 373, DIG. 27

[56] References Cited

U.S. PATENT DOCUMENTS

| | | | |
|---|---|---|---|
| 2,298,938 | 10/1942 | Griffin, Jr. et al. | 220/373 |
| 2,314,963 | 3/1943 | Zelnis | 220/373 X |
| 3,319,836 | 5/1967 | Cubitt | 220/367 X |
| 3,507,708 | 4/1920 | Vignaud | 220/373 X |
| 3,610,263 | 10/1971 | Walters | 220/202 X |
| 3,907,605 | 9/1975 | Melone | 220/371 X |
| 4,618,071 | 10/1986 | Vincent | 220/371 |
| 4,921,124 | 5/1990 | Stammler et al. | 220/367 |

FOREIGN PATENT DOCUMENTS

| | | |
|---|---|---|
| 0039869 | 11/1981 | European Pat. Off. . |
| 8017121 | 12/1980 | Fed. Rep. of Germany . |

OTHER PUBLICATIONS

Fry, "Water-Impervious Vent for Electrical and Similar Equipment", Research Disclosure, vol. 2244, No. 275, p. 149 (Mar. 1987, N.Y., N.Y.).

WPI Abstract of Lösch & Kupec/Siemens, Disclosure DE-OS No. 3017874=BR8102830=EP39869.

*Primary Examiner*—Steven M. Pollard

*Attorney, Agent, or Firm*—Frishauf, Holtz, Goodman & Woodward

[57] ABSTRACT

A pressure equalizing element for an electrical device enclosure, e.g. for a control device under the hood of a vehicle, features a water-tight but air-transmitting region (6) which equalizes pressure between the interior airspace of the enclosure and ambient airspace. The element is preferably thimble-shaped so that all exterior surfaces are curved and water will not pool on it and clog the air pores. Thus, it will be operative, and can be installed, in any desired orientation. The thimble-shaped element preferably has a threaded (40) or dovetailed (4) rim which facilitates engagement with a correspondingly shaped aperture in the wall of the electrical device enclosure.

5 Claims, 1 Drawing Sheet

PRESSURE COMPENSATING ELEMENT FOR ELECTRICAL DEVICE ENCLOSURE

The present invention relates generally to enclosures for electrical devices and, more particularly, to such an enclosure with a pressure compensating or equalizing element.

BACKGROUND

Pressure equalizing elements assist in the ventilation of tightly closed housings, particularly of electrical circuit devices, as they are used in motor vehicles. Such elements minimize the seeping of water into the housing interior, but permit compensation of pressure differences, for example arising from temperature changes, between the interior air and the surrounding environment. Pressure equalization is, however, only assured if water reaching the outer surface of the pressure equalization element can immediately run off.

It is known to use, as a pressure compensating element, a flat membrane of air-transmitting material, for example, a polytetrafluoroethylene (PTFE) foil material. This membrane permits compensation of pressure differences between the two sides of the membrane.

The disadvantage of these known pressure equalizing elements is that the pressure equalization is not possible if water is standing on the membrane. This means that such an element can only be located in the housing wall of such an electrical device, in order that water reaching the membrane will run off.

THE INVENTION

The pressure equalizing element with the continuous external curvature of the present invention has the advantage that any installation position desired can be selected, without impairing the function of the element. Even if water streams across a housing or electrical enclosure equipped with this inventive pressure compensating element, runoff of the water is assured and trouble-free pressure equalization is possible. It comprises a tube segment closed on one end and having air passage regions. These regions are curved in such a manner that water immediately runs off. The inner and outer surfaces of the tube segment communicate respectively with the surrounding air and the interior of the device or housing, so that pressure changes, e.g. resulting from temperature fluctuations, are compensated.

According to a preferred embodiment, the membrane is part of an integrally formed tube segment closed on one end. A particular advantage of this pressure equalizing element is its simple structure, which permits manufacturing the element very inexpensively.

Further features and embodiments include integrally forming the element from a single piece of PTFE and providing a dovetailed or threaded rim for engaging a device enclosure. A particularly desirable feature is that the structure permits automatic mass production in great quantities and testing before the element is needed. Furthermore, the dimensions of the element are so small that it can be universally used, even in small electrical devices.

DRAWINGS

Two embodiments of the invention will be described with reference to the drawings, of which FIG. 1 illustrates a first embodiment of a pressure equalizing element of the invention, made from one piece; and FIG. 2 illustrates a second embodiment of a pressure equalizing element of the invention, made from one piece.

DETAILED DESCRIPTION

Figure 1:
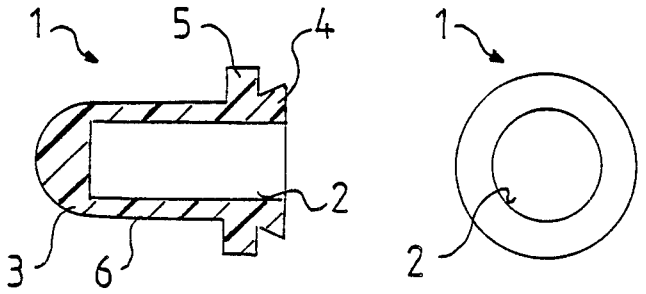

FIG. 1 illustrates a first embodiment of a pressure equalizing element. On the left side, a longitudinal cross-section is shown, and on the right side, an end view of the element, as seen from the right end of the cross-sectional view. The element is preferably integrally formed and essentially thimble-shaped, i.e. generally cylindrical with a closed end. The transverse cross-section of the element can be arbitrarily selected; although a circular cross-section is shown, other possibilities will be readily apparent to those skilled in the art.

As the longitudinal cross-section indicates, pressure equalizing element 1 is formed with an opening 2 at one end and a floor at the opposing closed end 3. Although the outer surface of closed end 3 is shown as hemispherical, other shapes are possible. The wall of the element near opening 2 is formed with an annular conical extension or rim 4, the small-diameter end of which transitions to a ring 5 with a circumferentially protruding flange portion. The cylindrical wall portion 6 beyond the flange, remote from opening 2, is porous to air and provides pressure equalization.

The pressure equalizing element is installed in a matching opening in a wall of an electrical circuit device. Conical extension or rim 4 holds the element pressure- and water-tightly in a housing wall (not shown), particularly if the opening in the wall is also conically shaped. In the installed position, ring 5 rests securely against the housing wall and stabilizes the element in place. Simultaneously, ring 5 facilitates the sealing action of conical extension 4.

Figure 2:
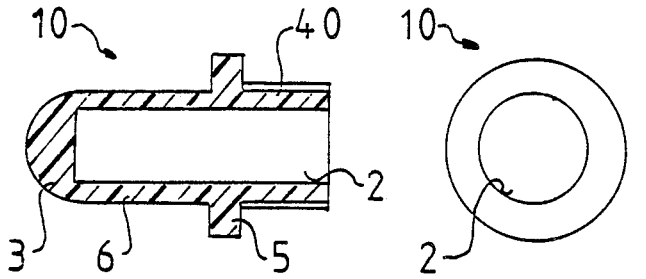

FIG. 2 illustrates another embodiment of a single-piece pressure equalizing element. Again, a longitudinal cross-section and an end view are provided. Between these views, a fragmentary view of an external screw thread is provided. Identical elements are given the same reference numerals as in the foregoing description, so they need not be described again.

The wall of the element, formed in a thimble shape, is provided on its outer surface adjacent opening 2 with a screw thread 40. This thread ends at ring 5 formed on the outer wall of the element. Wall region 6 between this ring 5 and floor or closed end 3 of the element is porous to air and serves to equalize pressure.

The pressure equalizing element shown in FIGS. 1 and 2 comprises a porous material, for example polytetrafluoroethylene (PTFE). The flow rate for air is about 0.06 liters per second per square centimeter. Water is resisted up to a pressure of about 0.03 bar (three-tenths of one atmosphere).

The installation orientation of the pressure equalizing element is arbitrary. For example, the floor or closed end 3 of the element can extend into the housing interior, if otherwise damage to the element is to be feared. It is, of course, equally possible to reverse the orientation in the housing wall and have opening 2 face into and communicate with the housing interior.

Various changes and modifications are possible within the scope of the inventive concept. So the wall thickness at 6, the length and the diameter of a pressure compensating element depend upon the volume of an electrical device to be ventilated and from the expected exchange of air when the electrical device is working.

I claim:

1. Pressure equalizing element, for an electrical enclosure, having a bidirectional filter region (6) with an inner surface contacting the interior airspace of said enclosure and an outer surface contacting surrounding ambient airspace, wherein said region (6) has pores which permit passage of dry air but resist passage of water, and said outer surface is formed as a convexly curved outer surface which facilitates runoff of any water present in said ambient airspace and thereby prevents clogging of said pores by said water and wherein said bidirectional filter region (6) is formed as part of an integrally formed generally tubular element having one end closed (1, 10).

2. Pressure equalizing element according to claim 1, further comprising means (4, 40), formed on said element adjacent said opening, for seating said element pressure- and water-tightly in a housing wall of an electrical enclosure.

3. Pressure equalizing element according to claim 2, wherein said means for seating (4) pressure- and water-tightly is a specially shaped rim adapted to engage a matching aperture edge in said electrical enclosure.

4. Pressure equalizing element according to claim 2, wherein said means for seating (40) pressure- and water-tightly is a screw thread formed on said element adjacent said opening (2) and adapted to engage a matching thread in a housing wall of an electrical enclosure.

5. Pressure equalizing element according to claim 1, wherein said element comprises polytetrafluoroethylene.

* * * * *